US006144156A

United States Patent [19]

Lutschounig et al.

[11] Patent Number: 6,144,156

[45] Date of Patent: Nov. 7, 2000

[54] ELECTROLUMINESCENT ELEMENT HAVING PARTICULAR ELECTRODE ARRANGEMENT

[75] Inventors: Ferdinand Lutschounig, Klagenfurt; Andreas Starzacher, Leibsdorf, both of Austria

[73] Assignee: U.S. Philips Corporation, New York, N.Y.

[21] Appl. No.: 09/060,087

[22] Filed: Apr. 14, 1998

[30] Foreign Application Priority Data

Apr. 16, 1997 [DE] Germany ..... 197 15 657
Jan. 22, 1998 [DE] Germany ..... 198 02 269

[51] Int. Cl.[7] ..... H01J 1/62; H01J 63/04

[52] U.S. Cl. ..... 313/506; 313/509; 313/521; 313/494

[58] Field of Search ..... 313/506, 509, 313/521, 494

[56] References Cited

U.S. PATENT DOCUMENTS 3,634,714 1/1972 Anderson et al. ..... 313/494
5,932,327 8/1999 Inoguchi et al. ..... 428/212

*Primary Examiner*—Vip Patel
*Assistant Examiner*—Karabi Guharay
*Attorney, Agent, or Firm*—Steven R. Biren

[57] ABSTRACT

The invention relates to the manufacture of electroluminescent elements on the basis of a so-called planar electrode arrangement (8*a*, 8*b*), whereby the modifications in accordance with the invention enable a substantial increase of the luminous power to be attained. To strengthen the electric field and hence increase the brightness, a special multilayer technology is employed. The electric field may be further strengthened by a film having a high dielectric constant. Preferably, a customary printed circuit board is used as the supporting board, so that the process in which the electroluminescent element is manufactured can be directly integrated in the printed-circuit-board manufacturing process. A further advantage of the invention is that the printed circuit boards provided with the optical components in accordance with the invention can be soldered by means of customary solder processes.

4 Claims, 4 Drawing Sheets

ELECTROLUMINESCENT ELEMENT HAVING PARTICULAR ELECTRODE ARRANGEMENT

BACKGROUND OF THE INVENTION

The invention relates to an electroluminescent element having a layered and/or planar electrode arrangement, which, upon application of a suitable supply voltage, can be made to emit light, and to the method of manufacturing and the application of said electroluminescent element.

The manufacture of electroluminescent elements having a so-called planar electrode arrangement is known from DE 19 34 946, DE 38 02 318 and 38 02 317. However, the manufacture of planar electrode arrangements as described in said documents has a number of serious drawbacks relative to the layered electrode arrangement (known from DE 40 23 693), so that at present there are no such planar elements on the market.

In this connection, for example, the developing electric field and hence the attainable brightness of the luminous element, generated by the luminous power of the luminescent pigments in an electroluminescent layer, are governed to a substantial degree by the distance between the electrodes. Technically, and above all economically, limits are set to the manufacture of a large number of parallel conductor tracks having a small interspace. The distance between electrodes arranged in a layered structure is typically less than half that of electrodes arranged in accordance with the planar technology. To compensate for this drawback of the planar structure, it is necessary to increase the electric field, which leads to additional expenditure on insulation.

SUMMARY OF THE INVENTION

It is an object of the invention to describe the structure of electroluminescent elements in different embodiments and to provide methods of manufacturing same, whereby the distances between the electrodes are substantially reduced relative to state of the art embodiments, so that the electroluminescent element can be manufactured at low cost and demonstrates a long service life, a high luminous power and functionality at the available power supply.

In accordance with the invention, this object is achieved by a selectively combined arrangement of the electrodes, the insulating films and the electroluminescent films, as claimed in the characterizing part of claim 1, and by methods of manufacturing these arrangements as claimed in the characterizing part of claim 5 and the following claim.

An essential feature of the invention is that a multilayered electrode arrangement for luminescent elements, partly in combination with additionally provided planar electrodes, is proposed, which luminescent elements exhibit an increased brightness.

The different arrangements of individual conductive and non-conductive films are obtained by squeegeeing a synthetic resin-coated copper foil and/or screen printing individual conductive or non-conductive films onto a copper-coated printed circuit board which serves as the supporting material.

Depending upon the intended application, one or more conductive or non-conductive films, which will be described in greater detail hereinafter, are applied to the basic body.

In the case of a multilayer structure, preferably a customary printed circuit board is used as the base material or supporting material for the electroluminescent element. A suitable structure is produced from the copper serving as the base material of the printed circuit board, which structure may consist of parallel-arranged conductor tracks as well as of differently arranged conductor tracks.

A synthetic resin-coated copper foil is squeegeed onto this structure in a special process. If the parallel electrodes of a pole are situated on the PCB serving as the supporting board and the electrodes of the second pole are made from the copper foil, then the great advantage is achieved that the electrodes of both poles are electrically separated from each other by the synthetic-resin coating of the copper foil (having a thickness, for example, of 30 $\mu$m).

The comb-like structure of the electrodes can be maintained, however, with this difference, that in this embodiment, the electrodes of both poles are situated on different planes.

The provision of the two electrode embodiments on two mutually insulated planes enables the distance between the electrodes to be varied or reduced at will, depending on how the copper tracks on the squeegeed copper foil are positioned relative to the conductor tracks on the material serving as the supporting board.

As the electrodes of each pole are arranged on different planes, the necessary conductor-track spacing per layer is increased correspondingly. By virtue thereof, the comb-like electrodes can be manufactured much more easily and economically from a process-technical point of view. In addition, the synthetic-resin coating of the copper foil is very uniform and hence ensures a constant distance between the two electrode layers.

A second embodiment is based on the first one. In this second embodiment, however, the copper film of the printed circuit board forms an additional electrode for enhancing the electric field, thus causing an additional excitation of the luminescent pigments in the electroluminescent film and hence a greater light output. This copper film is connected in an electrically conducting manner to the overlying film. The electrode for the second pole is superposed on the insulating film of the copper foil. As a result, upon applying an electric voltage to the poles, two electric fields are formed. The effect of the first field corresponds to that in the above-mentioned embodiment; the second field is formed above the first field, between the cover electrode and the additional electrode formed from the p.c.b.—copper coating, thus enhancing the first field. The embodiment of the electrodes can be selected in accordance with the requirements.

In another embodiment, apart from the synthetic resin-coated copper foil, an insulating film may be provided by screen-printing, which insulating film is subsequently provided with conductor tracks by means of different conductive pastes on the basis of copper, silver or carbon, so that in total three conductive films are superposed.

Subsequently, the electroluminescent film is provided by printing. A dielectric, which is preferably embodied so as to be reflective, may be printed below this electroluminescent film 6. The dielectric may alternatively be formed by the supporting resin of the electroluminescent dye film. As a result, separate dielectric and/or insulating films can be omitted.

As the electric field strength necessary for electroluminescent excitation, i.e. several $10^6$ Volt per cm, is attained only in the regions between the two electrode embodiments, phosphor pastes are only made to emit light in these regions. By virtue thereof, a sufficiently fine electrode arrangement enables a substantially flat luminous field as well as a specially designed luminous field item to be achieved.

Subsequently, a transparent patterned or cover film can be applied to obtain the desired design.

In a further embodiment, additives may be admixed with the supporting resin of the luminescent pigments or with the transparent cover lacquer to increase the dielectric constant of these films (typically 3–5 at 1000 Hz), or a separate film exhibiting the property of a high dielectric constant may be applied to the luminescent pigment film. As a result, the strength of the electric field can be increased, which brings about an additional excitation of the luminescent pigments.

These and other aspects of the invention will be apparent from and elucidated with reference to the embodiments described hereinafter.

DESCRIPTION OF THE PREFERRED EMBODIMENTS

Figure 1:
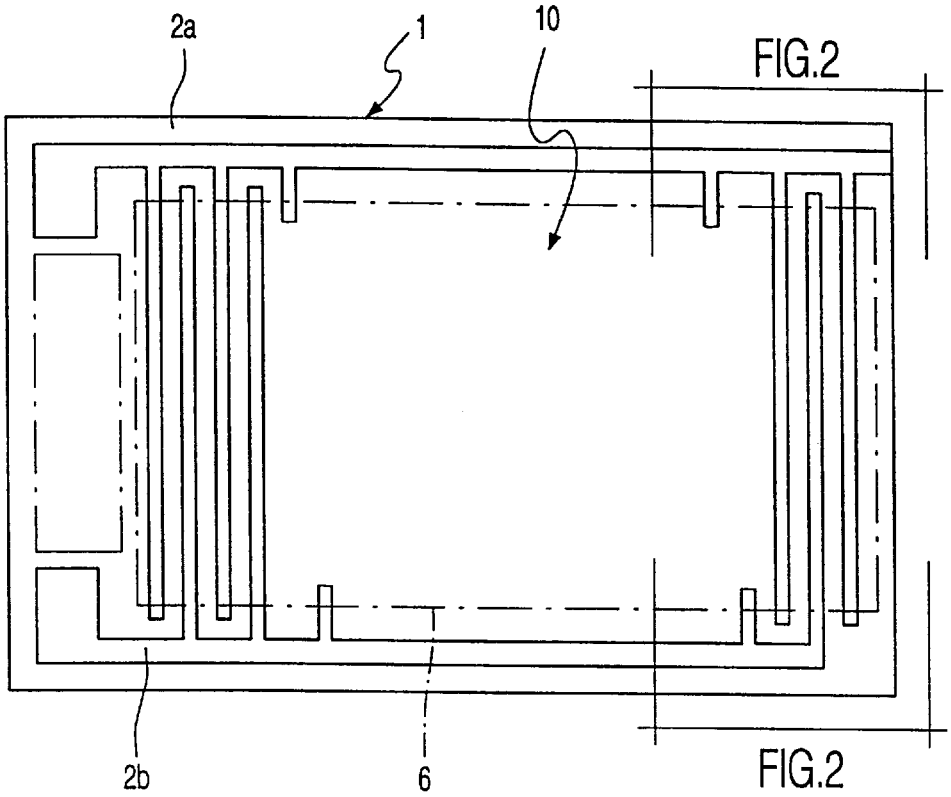
FIG. 1 is a plan view of an electroluminescent field with a planar bipolar electrode arrangement.

In FIG. 1, a printed circuit substrate 1 is provided with structured copper conductor tracks 2*a* and 2*b*, whereby the conductor track 2*a* constitutes one electrode (pole a of the voltage supply) and conductor track 2*b* constitutes the other electrode (pole b of the voltage supply) of the electroluminescent element. The base electrodes 2*a*, 2*b* may first be provided with an insulating film or a dielectric film having a good reflective effect. In this example, however, the electrode arrangement is directly provided with a film of an electroluminescent dye 6. Said electroluminescent dye 6 is mixed with a suitable, electrically insulating carrier substance, so that a separate insulating film can be dispensed with. Customarily, a protective film covering the entire surface and extending as far as the copper connecting surfaces is subsequently provided; in this case, preferably, a transparent solder-stop lacquer is used, thus ensuring solder-bath resistance and providing an additional shield against water vapor. Depending on the particular embodiment, various insulating or dielectric films may be added or omitted in an effective order.

Figure 2:
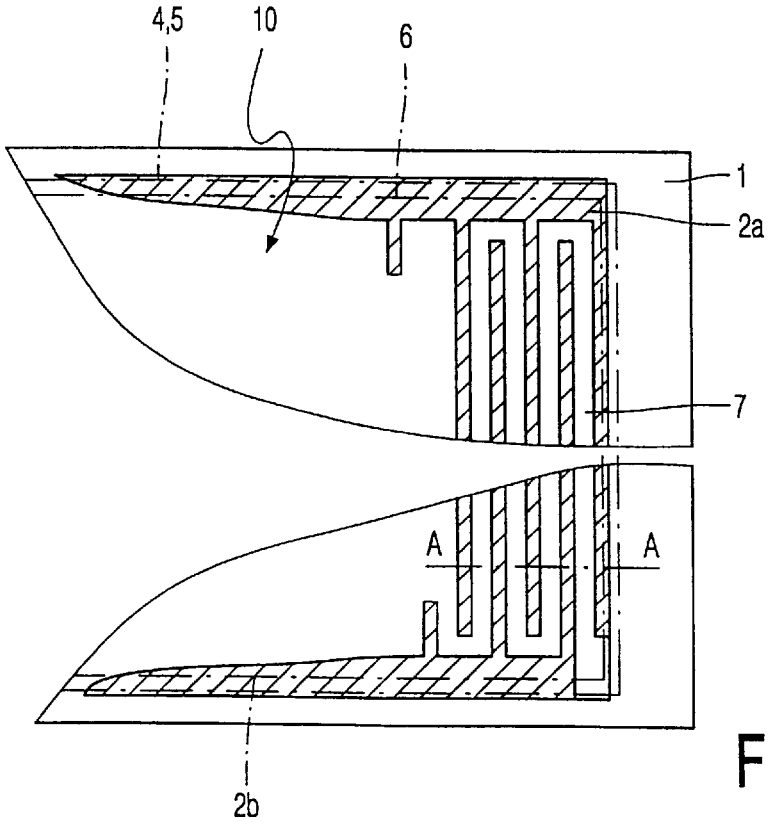
FIG. 2 is a plan view of a part of the planar bipolar electrode arrangement shown in FIG. 1.

FIG. 2 shows a sectional view, on an enlarged scale, of the planar electrode arrangement shown in FIG. 1. The Figure shows that the electrodes 2*a*, 2*b* are arranged so as to entirely cover the intended luminous surface 10 and are interdigitated, so that a meander-shaped intermediate space 7 is formed between the electrodes. The width of the electrodes preferably ranges from 50 $\mu$m to 500 $\mu$m. The electrodes 2*a*, 2*b* are alternately arranged on the substrate with a small interspace 7 which ranges preferably from 50 $\mu$m to 500 $\mu$m. Next, one or two electrically insulating dielectric films 4, 5 are printed onto this electrode arrangement, which films 4, 5 may be dispensed with, depending on the choice of the luminescent dye.

Subsequently, the dielectric film 4, 5 is printed with an electroluminescent film 6, preferably in the region of the intermediate space 7 between the electrodes 2*a*, 2*b*. If a voltage is applied to the electrodes 2*a*, 2*b*, then an electric field is formed in the intermediate space 7 between the electrodes 2*a* and 2*b*, which electric field causes the luminescent film 6 above this region to emit light.

Figure 3:
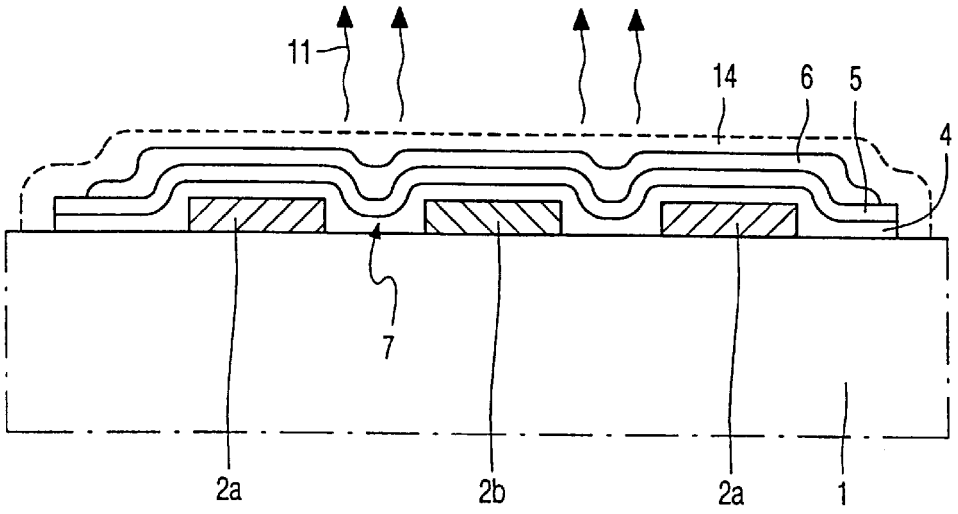
FIG. 3 is a cross-sectional view taken on the line A—A of the planar bipolar electrode arrangement shown in FIG. 2.

FIG. 3 is a cross-sectional view, taken on the line A—A, of the arrangement shown in FIG. 2. The Figure shows the alternately arranged electrodes on the substrate 1 and the insulating and luminescent films 4–6 printed in layers on the electrode arrangement. The main direction of radiation of the luminescent element is indicated by means of arrows 11.

In this Figure, the planar electrode arrangement, composed of the electrodes 2*a*, 2*b*, is covered by a first insulating film 4. This insulating film 4 should exhibit good insulating properties and a small dielectric constant.

The second insulating film 5 situated on said first insulating film should exhibit good reflective properties. This is achieved, for example, by adding white pigments. Thus, the insulating film 4 is mainly used as an insulator, while the insulating film 5 is mainly used as a good reflector.

Figure 4:
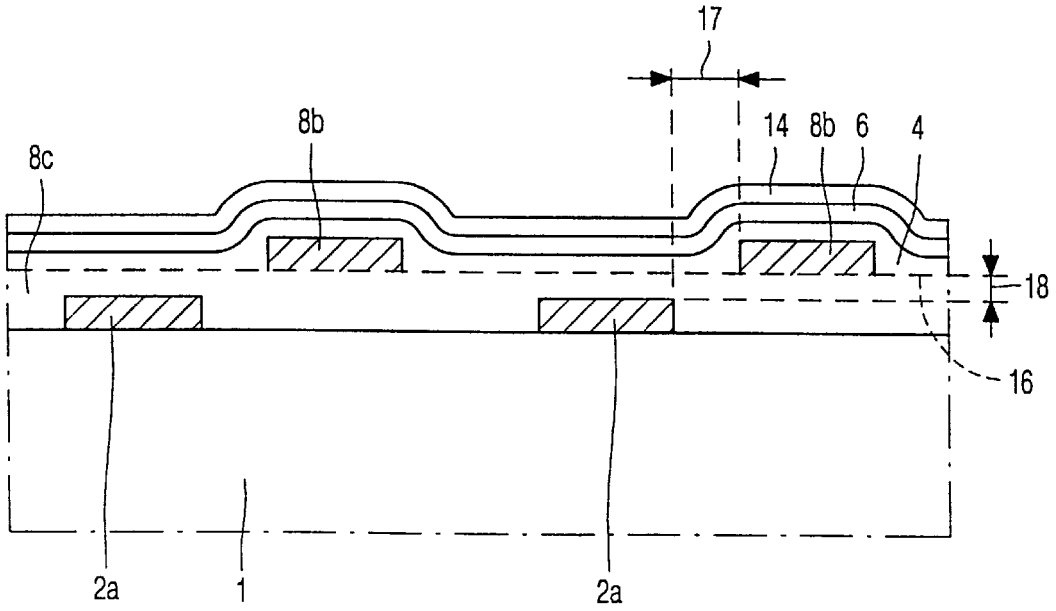
FIG. 4 is a cross-sectional view of an electroluminescent field, the electrodes 2*a* of one pole a being formed by the copper film of the printed circuit board, and the electrodes 8*b* of the second pole b being formed by a squeegeed copper foil.

FIG. 4 shows an embodiment of an electroluminescent element having a layered structure. The electrodes 2*a* for the pole (a) of the voltage supply are formed from the copper coating of the supporting board of the PCB. The electrodes 8*b* for the second pole (b) of the voltage supply are made from a squeegeed synthetic resin-coated copper foil.

This electrode arrangement can be provided with an insulating film or dielectric film 4 having a good reflective effect. Subsequently, the electroluminescent film 6 and the cover film 14 are provided by printing. The electrodes 2*a* are electrically interconnected and the electrodes 8*b* are also electrically interconnected, thus forming poles (a and b, respectively) of the luminescent element.

A characteristic feature of this embodiment is that at first a copper coating is present on the substrate 1, the conductor tracks of the poles 2*a*, which are defined later on, being screen-printed by means of an etch-resistant lacquer. Any excess copper is subsequently etched away, so that the polls 2*a* remain.

Printing of the poles 8*b* in the same plane as the poles 2*a* would have the disadvantage that, owing to the screen-printing technique, the minimum spacing between the poles may not fall below a specific value. Otherwise, the relatively small distances would cause electric short-circuits, which would adversely affect the functionality of the electroluminescent element.

This problem is solved, in accordance with the invention, in which the poles 8*b* are formed by a squeegeed copper foil whose bottom side is provided with a synthetic resin coating. The coating 8*c* is squeegeed onto the previously etched poles 2*a* and serves as an insulation between these poles 2*a* and, of course, also as an insulation with respect to the overlying poles 8*b* having a different polarity. Consequently, this synthetic resin coating 8*c* penetrates the intermediate space between the poles 2*a* and hence insulates them from each other.

Similarly, the poles 8*b* are etched from a synthetic resin-coated copper foil, so that a parting line 16 is formed on which the poles 8*b* are situated. Superposing the two poles 2*a,* 8*b* so as to obtain a layered structure enables the distance 17 between these two poles to be minimized in a decisive manner, without the risk of short-circuits or flashovers between these two electrodes.

By virtue thereof, the brightness of the luminescent element can be improved substantially, while the distance 17 can be kept very small.

The distance 17 is limited by the thickness of the synthetic resin coating 8*c* extending from the upper side of the one electrode 2*a* in the direction of the lower side of the other electrode 8*b*.

Additionally, an insulating film 4 may be provided, which, for example, may also be colored white so as to form an additional reflective film for the luminescent element. However, said insulating film may also be dispensed with.

If this insulating film 4 is available, it may be made of such a synthetic resin material, with optionally admixtures of substances, that a high dielectric constant is obtained which causes the brightness of the resultant luminescent element to be substantially further improved.

This insulating film 4 is provided by screen-printing. Above this film, the phosphor pigment-carrying electroluminescent film 6 is applied, also by screen-printing.

In this example, it is important that said electrodes 2*a,* 8*b* are not provided in a juxtaposed planar arrangement but in a layered, superposed arrangement, so that the distances 17 between the electrodes can be minimized substantially and hence much higher field strengths can be generated in this field gap.

The distance 17 may even be substantially zero or negative, in which case the electrodes 2*a,* 8*b* even demonstrate an overlap. Also in the case of an overlap, the electroluminescent film 6 can still be interspersed with sufficient lines of force since, also in the case of an overlap, a stray field is formed between the two overlapping superposed electrodes 2*a,* 8*b,* and the electroluminescent film 6 is at least partly interspersed with said stray field, which causes the film to emit light.

Particularly as a result of the fact that the insulating film 8*c* is a very good insulator, the lines of force are made to orient themselves in such a way that the orientation between the superposed electrodes 2*a,* 8*b* does not follow a straight line; instead, a considerable stray field will develop, which is suitable to make the electroluminescent film 6 emit light.

It is preferred, however, that the distance 17 has a positive value, i.e. there is no direct vertical overlap between the two electrodes 2*a,* 8*b*.

In the case of juxtaposed planar electrodes, a distance of 150 micrometers was selected, which, from the viewpoint of manufacture, is very difficult to control. If the electrodes 8*b* are transferred to a next higher layer, then a distance between the electrodes 2*a* of equal polarity of 500 micrometers is achieved, which distance is much easier to control, from the viewpoint of manufacture, than the above-mentioned smaller distance.

The synthetic resin-coated copper foil 8 supporting the electrodes 8*b* is squeegeed onto the as yet exposed electrodes 2*a,* so that also a vertical distance 18 is formed, which, in FIG. 4, is defined as extending from the lower side of the upper pole 8*b* towards the upper side of the lower pole 2*a*.

As a result of said squeegeeing operation, the electrodes may demonstrate an overlap, i.e. the distance 18 may be reduced to zero or even assume a negative value.

A negative distance 18 is preferred, i.e. the electrodes 2*a,* 8*b* demonstrate an overlap in the vertical direction and, apart from small differences, again form an essentially flat plane. In this connection, it is important that the electrodes 2*a,* 8*b* were manufactured in separate manufacturing processes, so that the technical teachings in accordance with the invention, enabling this element to be of a layered structure, make it possible to achieve substantially smaller distances between the electrodes, without the risk of problems in the course of the manufacturing process.

Figure 5:
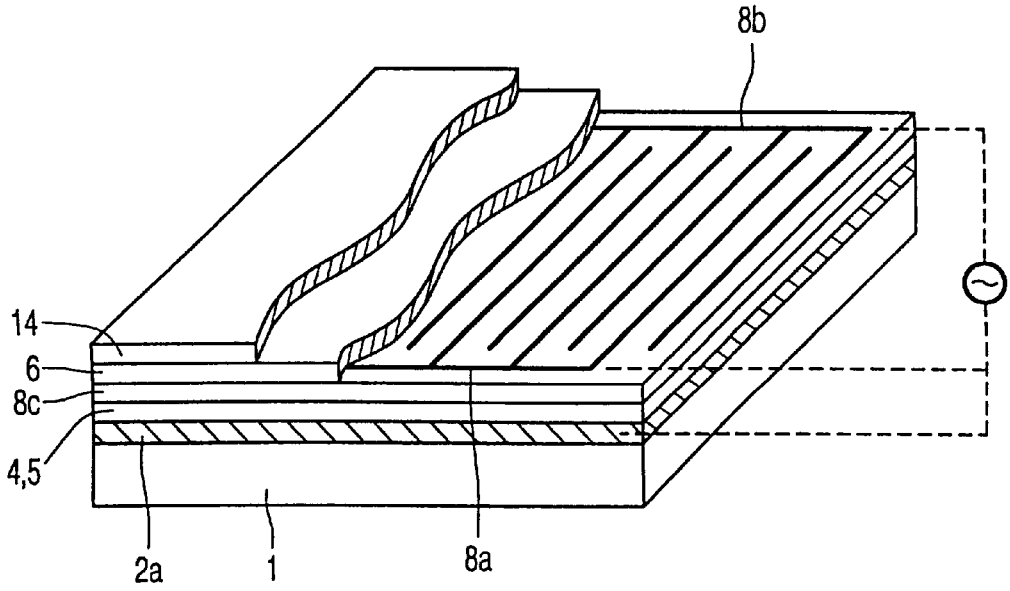
FIG. 5 is a cross-sectional view of an electroluminescent field with a planar electrode arrangement 8*a*, 8*b* and an additional underlying electrode 2*a*, which is formed from the conductor layer of the printed circuit board and serves to strengthen the electric field.

FIG. 5 is a cross-sectional view of a planar electrode arrangement 8*a* and 8*b*. In addition to the planar electrode arrangement 8*a* and 8*b,* the Figure shows an additional electrode 2*a,* which may have any structure and which is made from the copper coating of the PCB supporting board. This additional electrode 2*a* is electroconductively connected to a pole of the planar electrode arrangement, in this case 8*a*.

At least one insulating film or dielectric film 4, 5 having a good reflective effect is arranged between the planar electrode arrangement and the additional electrode.

The planar electrode arrangement is produced either by squeegeeing a synthetic resin-coated copper foil 8*a,* 8*b* or by screen printing of conductive pastes. In the case of a synthetic resin foil, the insulating or dielectric film(s) 4, 5 can be dispensed with since the coating of the copper foil already demonstrates these dielectric properties.

The additional electrode 2*a* causes the developing field to be strengthened and distorted in the region of the planar electrode arrangement 8*a,* 8*b*. This results (owing to the addition of the additional electrode) in an increase of the stray field, which is formed anyway between the finger-shaped electrodes 8*a,* 8*b,* because a displacement effect occurs.

Figure 5A:
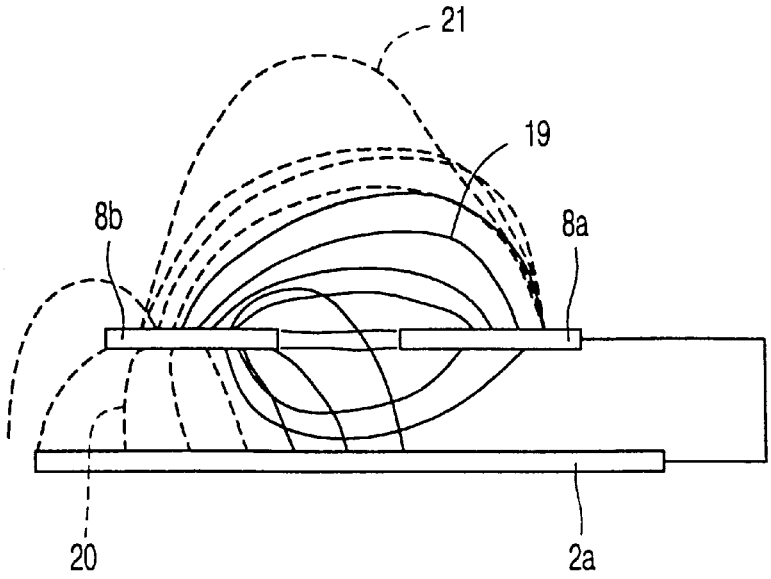
FIG. 5*a* shows the build-up of the field in the arrangement shown in FIG. 5.

In FIG. 5*a,* these effects are shown in greater detail. This Figure shows that the additional electrode is embodied so as to be a copper foil 2*a* which is electroconductively connected to the upper conductor track 8*a,* the copper foil and the upper conductor track together forming one pole of the potential. The second pole of the potential is formed by the poles of the conductor track 8*b*.

The continuous lines represent the lines of force 19, which would occur if the additional electrode 2*a* was absent.

If additional electrodes are included and, at the same time, conductively connected to the conductor tracks 8*a,* the field of the line of force 19 will be expanded as shown by the interrupted lines. First, lines of force 20 will occur between the electrodes 8*b* and 2*a* of different polarity, as shown in FIG. 5*a*. It is important, however, that owing to the additional lines of force 20, the lines of force 19 are displaced upwards and form further lines of force 21, which very favorably penetrate the overlying (not shown) luminescent film and cause it to exhibit an increased light emission. By virtue thereof, the brightness of the luminescent film is improved substantially.

In the example in accordance with FIG. 5, it is important that, of course, the electrodes 8*a* and 8*b* cannot only be arranged so as to be juxtaposed in one plane, but also, as described in the above example in accordance with FIG. 4, in vertically superposed layers in such a way that they are partly staggered relative to each other.

Consequently, the provision of an additional electrode 2*a* is claimed as being essential to the invention in planar electrode arrangements in accordance with the example shown in FIG. 5, and is preferred in the staggered electrode arrangement in accordance with the example shown in FIG. 4.

Figure 6:
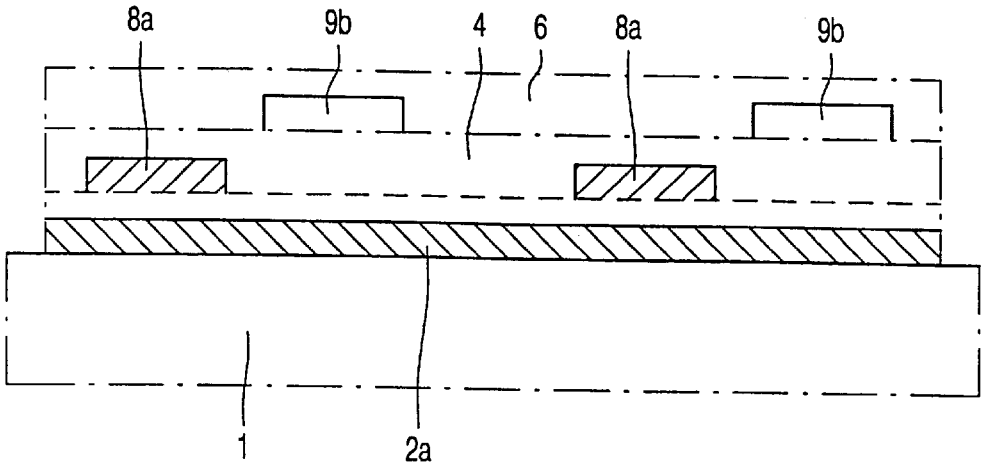
FIG. 6 is a cross-sectional view of an electroluminescent field with a layered electrode arrangement 8*a* and 9*b* and an additional electrode 2*a* which serves to strengthen the electric field, the juxtaposed planar electrodes 8*a* or 9*b* of a pole being composed of copper foil and/or of screen printed conductive pastes.

FIG. 6 is a cross-sectional view of an embodiment of an electroluminescent element comprising three insulated, superposed, conductive films 2*a,* 8*a,* 9*b.* The lower conductive film 2*a* is obtained from the printed circuit board, the central conductive film 8*a* is obtained from the synthetic resin-coated copper foil, and the third conductive film 9*b* is produced by screen printing different conductive pastes on the basis of copper, silver, carbon or other conductive materials. An insulating film 4 is situated between the electrode arrangements.

Thus, FIG. 6 shows the above-mentioned combination of the embodiments of FIGS. 4 and 5, since FIG. 6 shows, in accordance with FIG. 4, electrodes 8*a,* 9*b* which partly overlap each other and are arranged in different layers. The upper electrodes 9*b* are conductive pastes screen printed onto the insulating film 4.

Figure 7:
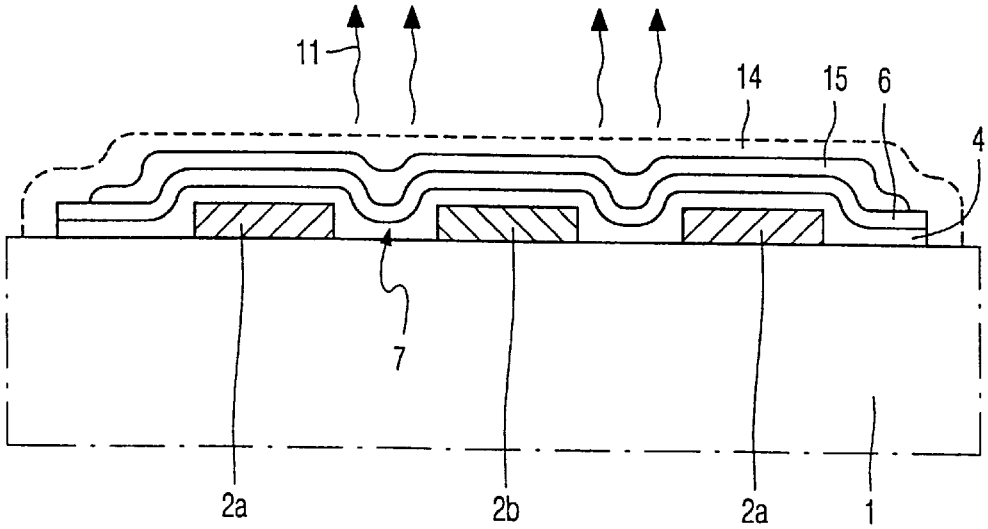
FIG. 7 is a cross-sectional view of an electroluminescent field with a planar electrode arrangement 2*a*, 2*b*, an additional film 15 having a high relative dielectric constant being applied to the electroluminescent film.

FIG. 7 shows a structure in accordance with FIG. 3. By means of an additional transparent film 15 having a high dielectric constant, a strengthening of the electric stray field between the electrodes 2*a* and 2*b* is achieved, resulting in a higher light output.

In FIG. 3, the luminescent film 6 is applied to two different insulating films 4, 5, whereas in FIG. 7, the luminescent film 6 is applied directly to the lower insulating film 4.

The electroluminescent film 6 and a cover film 14 are provided on the planar electrode arrangement. Optionally, an additional transparent film 15 having a high dielectric constant, as shown in FIG. 7, can be provided on the electroluminescent film.

Explanation of the Reference Numerals used in the Drawings

1 substrate (printed circuit board)
2*a* copper foil (coating of the printed circuit board) (embodied so as to be an electrode of pole a)
2*b* copper foil (coating of the printed circuit board) (embodied so as to be an electrode of pole b)
4 insulating film 1
5 insulating film 2
6 electroluminescent film
7 intermediate space between the electrode embodiments
8*a* conductor track of the copper foil of pole a
8*b* conductor track of the copper foil of pole b
8*c* coating of the copper foil
9*b* conductive paste of pole b
10 luminous surface
11 direction of radiation
14 (patterned) cover film
15 transparent film having a high dielectric constant
16 parting line
17 spacing (horizontal)
18 spacing (vertical)
19 lines of force
20 lines of force
21 lines of force

What is claimed is:

1. An electroluminescent element comprising an electrode arrangement having two groups of electrodes of two different polarities provided on a supporting board and at least one electroluminescent film provided in the region of this electrode arrangement, the electrodes being arranged on the supporting board and separated from each other by an intermediate space, and the electroluminescent film being arranged at least in the region of this intermediate space, characterized in that to strengthen the electric field and hence increase the brightness of an electroluminescent element, a reduction of the electrode spacing is achieved by arranging the electrodes of each group to be at least partly vertically offset and at least partly staggered relative to each other.

2. An electroluminescent element comprising an electrode arrangement having two groups of electrodes of two different polarities provided on a supporting board and at least one electroluminescent film provided in the region of this electrode arrangement, the electrodes being arranged on the supporting board and being separated from each other by an intermediate space, and the electroluminescent film being provided at least in the region of said intermediate space, characterized in that, the electrodes are planar and juxtaposed, and at least one further electrode is arranged below the planar juxtaposed electrodes, which further electrode is conductively connected to one of the planar electrodes.

3. An electroluminescent element as claimed in claim 1, characterized in that the supporting board is a customary printed circuit board, and the electrodes are formed by the electroconductive film of the printed circuit board.

4. An electroluminescent element as claimed in claim 1, characterized in that the electrodes are directly integrated in a PCB layout or a PCB wiring.

* * * * *